United States Patent [19]

Gencsoy

[11] 4,025,317

[45] May 24, 1977

[54] HIGH PRESSURE ROTARY PISTON COAL FEEDER FOR COAL GASIFICATION APPLICATIONS

[75] Inventor: Hasan T. Gencsoy, Morgantown, W. Va.

[73] Assignee: The United States of America as represented by the United States Energy Research and Development Administration, Washington, D.C.

[22] Filed: Aug. 12, 1976

[21] Appl. No.: 713,751

[52] U.S. Cl. ..... 48/86 R; 48/77; 202/262; 214/17 B; 222/194

[51] Int. Cl.[2] ..... C10J 3/30; C10J 3/50

[58] Field of Search ..... 48/86 R, 77, 76, 101, 48/210; 201/6, 24; 202/262; 214/17 A, 17 B, 17 C; 222/194, 410

[56] References Cited

UNITED STATES PATENTS

| | | | |
|---|---|---|---|
| 1,372,765 | 3/1921 | Miller | 48/86 R |
| 1,970,153 | 8/1934 | Steere | 48/86 R |

*Primary Examiner*—Robert L. Lindsay, Jr.
*Assistant Examiner*—George C. Yeung
*Attorney, Agent, or Firm*—Dean E. Carlson; David S. Zachry; Earl L. Larcher

[57] ABSTRACT

The subject development is directed to an apparatus for feeding pulverized coal into a coal gasifier operating at relatively high pressures and elevated temperatures. This apparatus is a rotary piston feeder which comprises a circular casing having a coal loading opening therein diametrically opposed from a coal discharge and contains a rotatable discoid rotor having a cylinder in which a reciprocateable piston is disposed. The reciprocation of the piston within the cylinder is provided by a stationary conjugate cam arrangement whereby the pulverized coal from a coal hopper at atmospheric pressure can be introduced into the cylinder cavity and then discharged therefrom into the high-pressure gasifier without the loss of high pressure gases from within the latter.

6 Claims, 2 Drawing Figures

Figure 1:
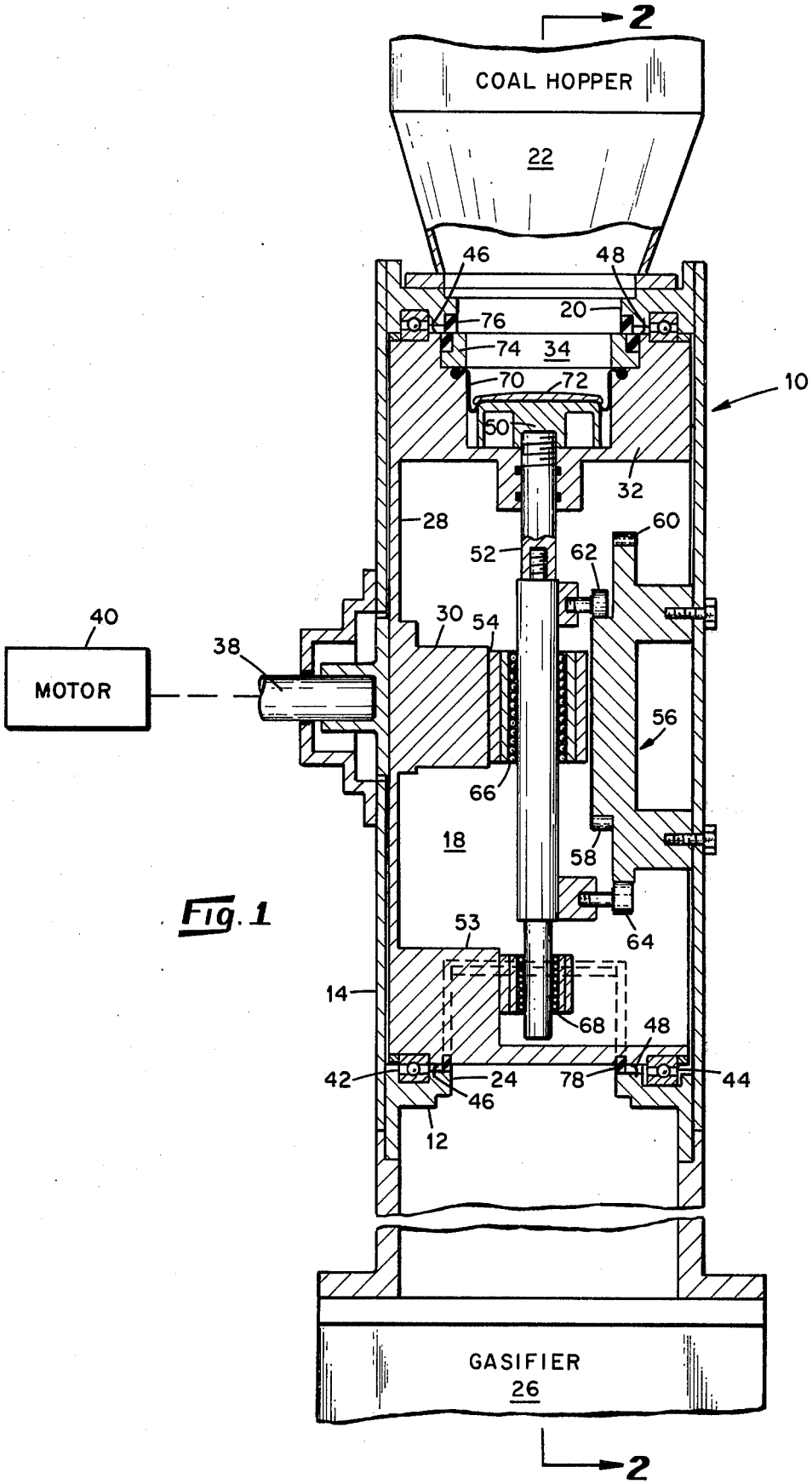

1
22

76
74
20
76
10
72
34
70
50
32
12
52
28
16
60
62
56
58
66
44
78
64
78
68
24
26
1

HIGH PRESSURE ROTARY PISTON COAL FEEDER FOR COAL GASIFICATION APPLICATIONS

This invention was made in the course of, or under, a contract with the United States Energy Research and Development Administration.

The present invention relates generally to apparatus for use in the conversion of coal to high or low Btu gas by gasification procedures and, more particularly, to a rotary piston coal feeder fro conveying pulverized coal from a coal hopper to a gasifier.

Because of the world-wide increased use of energy resources, there is an ever growing demand for new sources of energy. The relatively small reserves of petroleum and natural gas has caused many people in the energy area to consider methods of converting the vast coal resources of the world to useable fuels. In this area, coal gasification is attracting increasing interest as a technique of converting coal to high and low Btu gas which may be readily used for applications such as electrical power generation. Of the various known coal gasification processes wherein pulverized coal is introduced into a coal gasifier there are several attendant shortcomings with the supporting equipment which detract from the desired efficiency of the processes. One of these efficiency-limiting shortcomings is in the area of introducing the pulverized coal into the process reactor without suffering a considerable loss of the process gas from within the reactor or requiring the use of additional pressurized fluids from outside sources for pressurizing the coal prior to its introduction into the reactor.

One presently employed technique for feeding coal into a coal gasifier is by using a lock-hopper arrangement which generally comprises one or more valid bins disposed between the coal hopper and the gasifier. Coal from the hopper is loaded into the bin at atmospheric pressure and then the bin is closed and a pressurizing fluid introduced into the bin through an appropriate valve to pressurize the bin to a pressure corresponding to that of the gasifier. The bin is then opened to discharge the coal into the gasifier. After discharging the coal the bin must then be depressurized before a further load of coal from the hopper can be placed therein.

Also, lock-hopper valves as presently known must operate over many cycles without leakage in a dusty and highly abrasive environment and are required to handle differential pressures of more than 500 psi. Usually, several stages of lock-hoppers are necessary in order to pressurize the coal from atmospheric pressure at the hopper to the operating pressure of the gasifier. The timing of the valves in the lock-hopper for opening, closing, purging, and pressurization requirements necessitate the use of a sophisticated system wherein a slight failure may result in the failure of the entire lock-hopper arrangement. Further, in lock-hopper arrangements the minimum volume of gas required for the pressurization of the coal into the vessel is equal to volume of the hopper less the volume of coal, but in actual practice this volume of gas is at least double the minimum because the lock-hopper cannot be completely filled full of coal. In a lock-hopper after the coal is discharged into the gasifier the gas in the lock-hopper is vented or otherwise saved for recompression and introduction in another lock-hopper. In any event, the power requirement for gas compression in order to pressurize the lock-hoppers to a pressure sufficient for introduction of the coal into the gasifier without suffering significant losses in product gases from within the gasifier results in a significant operating cost. Also, the gas used for pressurizing the lock-hoppers presents some problems in that, for example, steam suffers from the problem of potential condensation and carbon dioxide has a natural tendency to liquefy at high pressures. Alternatively, if product gas is used as the lock-hopper pressurizing fluid, this gas would have to be cleaned, recycled, and recompressed so as to impose additional efficiency losses and cost problems upon the overall system.

Accordingly, it is the primary aim or goal of the present invention to provide a coal transfer means for feeding coal into a coal gasifier without the loss of gas from the gasifier and without the use of external pressurized fluids for effecting the transfer thereof. This goal is achieved by using a coal transfer device for transferring pulverized coal from a coal hopper at a relatively low presure, e.g., atmospheric pressure, to a coal gasifier operable at a significantly higher pressure than that of the hopper. The transfer device comprises a casing having diametrically opposed openings, one of which is in open communication with the low pressure hopper and the other of which is in open communication with the gasifier. A discoidal rotor is disposed and rotatable within the casing and has a cavity therein defining a cylinder in open registry with the periphery of the rotor. Seal means are disposed intermediate the rotor and the casing for interrupting fluid communication between the openings. A piston is disposed in the cylinder and has a piston rod attached thereto which projects diametrically through the rotational axis of the rotor. Contoured stationary cam means are carried by the casing and cam follower means are affixed to the piston rod for engaging the cam means. Drive means are coupled to the rotor for rotating the rotor about the rotational axis while simultaneously driving the cam follower means along the contour of the cam means for reciprocating the piston within the cylinder. The contour of the cam means are of a configuration wherein the piston is displaced towards and maintained at a location contiguous to the outermost periphery of the rotor while the piston is in open communication with the opening into the gasifier for inhibiting gas from the gasifier from entering the cylinder.

Other and further objects of the invention will be obvious upon an understanding of the illustrative embodiment about to be described, or will be indicated in the appended claims, and various advantages not referred to herein will occur to one skilled in the art upon employment of the invention in practice.

A preferred embodiment of the invention has been chosen for the purpose of illustration and description. The preferred embodiment illustrated is not intended to be exhaustive or to limit the invention to the precise form disclosed. It is chosen and described in order to best explain the principles of the invention and their application in practical use to thereby enable others skilled in the art to best utilize the invention in various embodiments and modifications as are best adapted to the particular use contemplated.

Figure 2:
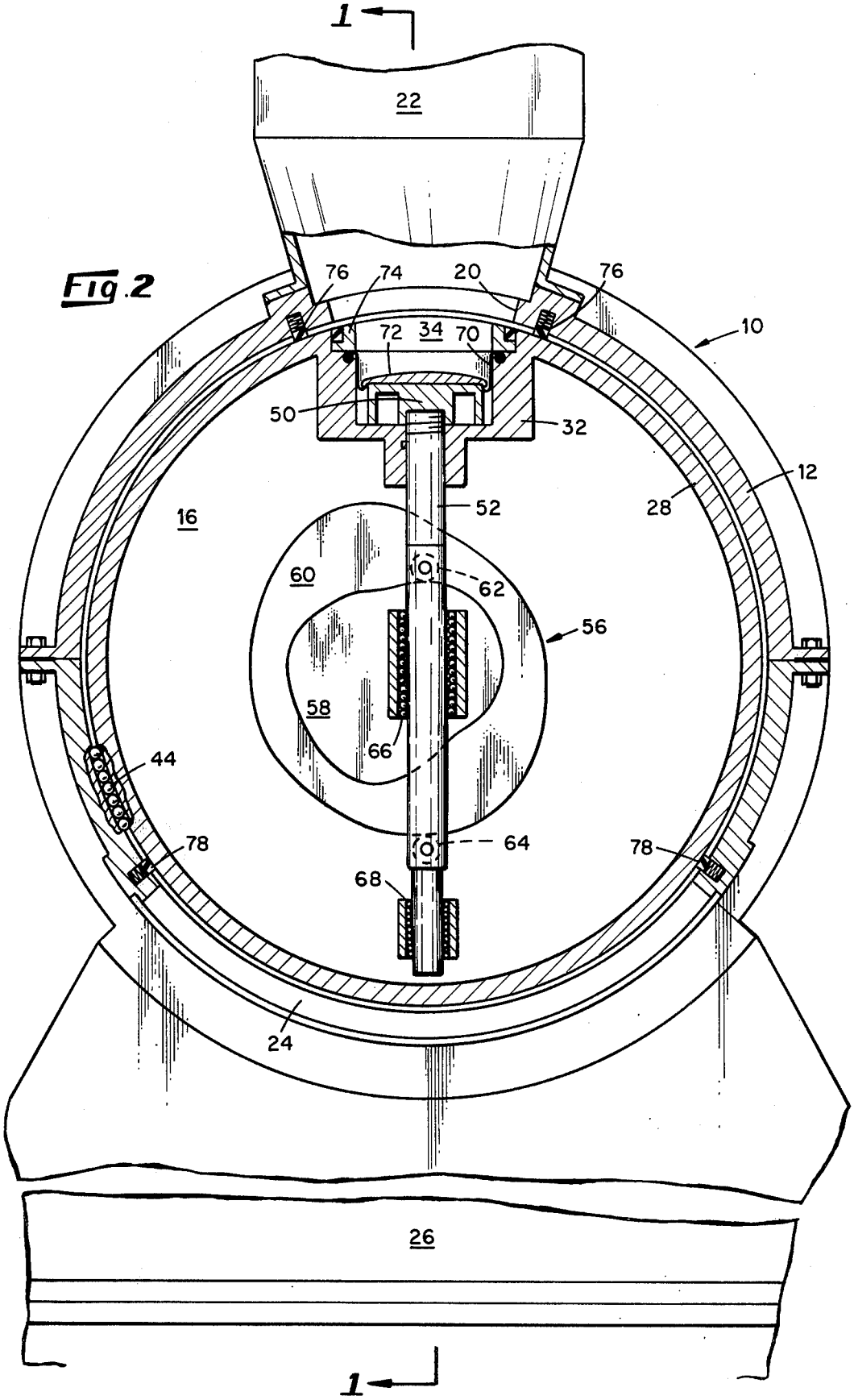

In the accompanying drawings:

FIG. 1 is an elevated sectional view of the rotary piston coal feeder of the present invention; and FIG. 2 is a sectional view taken along line 2—2 of FIG. 1 showing further details of the coal feeder especially the conjugate cam arrangement utilized for displacing the piston in the coal feeder.

Described generally, the coal transfer apparatus of the present invention is used for feeding dry pulverized coal into a coal gasifier operating at a pressure in the range of about 100–1500 psig and a temperature in the range of about 1700° to 2500° F. However, the transfer apparatus is located at such a distance from the gasifier that the ambient temperature around the coal feeder discharge chute is in the range of about 350°–580° F. This coal transfer apparatus conveys the coal form a coal hopper operated or maintained at or near atmospheric pressure to the substantially higher operating pressure of the gasifier without the use of an external pressurizing fluid and without incurring any loss of the produce gas from within the gasifier so as to maintain the gas production efficiency of the gasifier at a suitably high level. The coal transfer apparatus consists of a rotary piston feeder in which a cylinder containing a displaceable piston is used as the coal-receiving and transferring recptacle or chamber. As the coal is discharged from the cylinder into the pressurized gasifier by gravity and the displacement of the piston, the latter is positioned adjacent to the top of the cylinder and remains in this position while in registry with the gasifier so as to, in effect, seal the cylinder volume or cavity from communication with the gasifier. This piston-cylinder relationship effectively insures that none of the aforementioned undesirable losses of product gas occurs. Further, with this piston-cylinder relationship no external source of fluid pressure is necessary to pressurize the coal conveyed from the low pressure hopper into the high pressure gasifier since the piston places a load on the coal prior to introducing it into the gasifier and then aids in ejecting the coal from the cylinder into the gasifier so as to obviate the use of any coal expelling fluid or other technique formerly used for feeding the coal into the gasifier.

Described more specifically, and with reference to the accompanying drawings, the coal feeding apparatus of the present invention is shown comprising a casing 10 defined by an annulus 12 to which end plates 14 and 16 are attached to define an enclosed hollow circular cavity 18. The annulus has an opening 20 therein which communicates with a coal hopper 22. Only a portion of hopper 22 is shown for illustrative purposes to show its orientation with respect to the coal feeder which is below the coal hopper for utilizing gravity feed therefrom. The coal hopper 22 contains pulverized coal at or near atomospheric pressure (zero psig). The annulus 12 has a second opening therein that is diametrically opposed to opening 20 with this opening 24 being in registry with a gasifier 26. The gasifier 26 is shown in fragmentary form and may be of any suitable well-known type using a fluid or fixed bed for converting the coal to useful high or low Btu gas. This gasifier may operate at any selected pressure in the range of about 100-1500 psig and a temperature in the range of about 1700°–2700° F.

Within the hollow circular cavity 18 of the casing 10 there is disposed a discoidal cup-shaped rotor 28 having a central boss 30 disposed on the axis of rotation of the rotor 28 and projecting into the cavity of the latter. The rotor 28 is also provided with an enlarged inwardly extending projection at one side thereof which contains a circular cavity open at the periphery of the rotor defining a cylinder 34 which houses the cam displaceable piston, as will be described below. The rotor 28 is rotatable within the casing cavity by a driven shaft 38 which projects through the end plate 14 and is coupled to a suitable drive motor and gear-reducing arrangement, generally shown at 40. In order to facilitate the rotation of the rotor 28 within the casing 10, a pair of annular bearings 42 and 44 are disposed within the annular spaced intermediate the annulus and the rotor 28 near the end walls 14 and 16, respectively. The bearings 42 and 44 are provided with suitable seals 46 and 48 for isolating the bearings from abrasive substances attendant with the transfer of the pulverized coal and the gasification process.

Within the cylinder 34 of the rotor 28, there is disposed a reciprocateable piston 50 of a configuration corresponding to and of a diameter slightly less than that of the cylinder 34. This piston 50 is, in turn, coupled to a piston rod 52 which extends through an opening in the innermost surface of the projection 32 and projects through the rotational axis of the rotor 28. This piston rod 52 is coupled to the rotor 28 at the boss 30 at the distal end 54 thereof and at an inwardly extending shoulder 53 near the periphery of the rotor 28 at a location opposite the cylinder 34 for rotation with the rotor 28 about the axis of the latter.

In order to reciprocate the piston 50 within the cylinder 34 as the rotor 28 is being rotated, a stationary conjugate cam 56 is affixed to the end plate 16. This cam 56 provides for the reciprocation of piston 50 in cylinder 34 along a specifically defined contour as the rotor revolves about its axis. The conjugate cam 56 is formed of a pair of cams consisting of a drive cam 58 and a return cam 60. These cams are, in turn, coupled to rod 52 through a pair of cam followers 62 and 64 which engage the drive cam 58 and the return cam 60, respectively. To provide for the reciprocation of the piston 50 within the cylinder 34, the piston rod 52 is coupled to the boss by suitable bearing arrangement such as a linear ball bearing 66. This bearing 66 provides for relative motion of the piston rod 52 with respect to the rotor 28 for the selective displacement of the piston within the cylinder 34 in accordance with the cam configuration and yet provides a coupling mechanism by which the piston rod 52 is rotated by the central boss 30 as the rotor 28 is rotated within the cavity of casing 10. A further bearing 68 which may be of a type similar to bearing 66 is preferably attached to the piston rod 52 adjacent the lowermost end thereof at the shoulder 53, as shown in the drawing, to provide a further aid in correctly maintaining the piston rod alignment within the cylinder 34. These linear roller bearings 66 and 68 provide minimal friction while maintaining the desired positive alignment of the piston rod during displacement thereof.

When the piston and cylinder are exposed to the pulverized coal feed and especially the high pressure gases within the gasifier, there is a need to prevent these gases as well as abrasive particulate matter in the gases and the coal feed from passing through the space between the piston and cylinder walls. A satisfactory seal for this purpose may be provided by placing a cup-shaped rolling diaphragm 70 of a suitable elastomeric material such as epichlorohydrin between the walls of the cylinder and the piston so that as the piston is reciprocated within the cylinder 34 a positive seal is established and maintained between the piston and the cylinder walls. As shown, the rolling diaphragm 70 is clamped to the piston by a piston cover 72 and an annular clamp 74 disposed about the upper periphery of the cylinder 34. The piston cover 72 is preferably provided with a curved, slightly hemispherical upper surface so as to more uniformily distribute the pressure load over the entire piston head.

As the rotor is rotated about the axis defined by the central boss the peripheral surface of the rotor is exposed to the high pressure gases an particulate matter in the gasifier 26 as well as pulverized coal in the hopper 22. Thus, in order to insure that this high pressure gas and particulate matter does not escape from the gasifier and coal hopper via the space between the rotor 28 and the annulus 12 suitable seal arrangements 76 and 78 are placed between the rotor and the annulus adjacent to the openings leading to the gasifier 26 and coal hopper 22, respectively. These seals 76 and 78 may be of any satisfactory construction which will not interfere with the rotation of the rotor and yet be capable of maintaining a fluid-tight seal between the rotor and the casing so that the only fluid and particulate communications between the coal hopper 22 and the gasifier 26 is provided by the cylinder 34 when it is in registry with one or the other.

As shown in the drawings, especially FIG. 2, the openings in the annulus 12 in registry with the coal hopper 22 and the gasifier 26 are of a size suitable for assuring the transfer of the coal from the hopper 22 to the cylinder cavity 34 and into the gasifier 26 when the cylinder is rotated within the casing so as to be placed within registry with the gasifier 26. To accomplish this transfer, the opening 20 in the annulus in registry with the hopper may extend over an arc of about 30° so as to permit a full load of coal to be discharged from the hopper into the cylinder by gravity feed when the cylinder is placed in communication therewith. The size of opening 24 in the annulus 12 in registry with the gasifier 26 preferably extends over an arc of about 90°–100° to assure that there is sufficient time to allow the piston to be moved the full length of the cylinder and be positioned in a sealing arrangement with the top of the cylinder for preventing gases from escaping from the gasifier as the cylinder portion of the rotor is rotated past the opening 24.

The profile of the conjugate cam 56, as best shown in FIG. 2, provides for the selective positioning of the piston 50 within the cylinder 34 so as to allow the cylinder 34 to receive a full load of coal from the coal hopper 22, subsequently eject this coal from the cylinder and effect the sealing of the cylinder from the gases within the gasifier, and then return the piston to the bottom of the cylinder for another loading of coal. A satisfactory cam configuration or profile provides for the positioning of the piston at the lowermost surface of the cylinder 34, which is the 0° position as it is shown in FIG. 2, so that coal from the hopper may be fed into the cylinder to fill the open cylinder. The design of the cam 56 is such that the piston position inside of the rotating cylinder will remain constant in a radical direction while the rotor moves clockwise through an angle of approximately 135° from the aforementiond 0° position. Then, during the next 75° of rotation the piston 50 is driven radially outwardly by the conjugate cam profile due to the cam follower 62 following the contour of cam surface 58. During this outward displacement of the piston 50 the cylinder is placed in registry with opening 24 and the coal is discharged from the cylinder 34 into the gasifier 26. When the piston reaches the top of the cylinder, which is the maximum outward position attainable for the piston, the top of the piston is adjacent to the outermost edge of the cylinder. The piston is held in this position for the next 60° of rotation so as to assure that gases and particulate matter from within the gasifier 26 will not enter the cylinder 34. As the rotor is further rotated beyond this last mentioned 60° angle, the piston 50 is then returned to the coal loading position over the next 75° of rotation by the cam follower 64 acting on the surface of cam 60. The piston 50 then dwells in this innermost retracted position for the final degrees of rotation for filling the empty piston cylinder 34 with the next full charge of coal.

The dimensions and capacities of the rotor piston coal feeder of the present invention are not critical to the invention since the feeder may be of any size suitable for use with any given gasifier. Also, if desired, a series of coal feeders may be disposed between a coal hopper and a gasifier for providing the gasifier with the needed quantity of coal.

It will be seen that the present invention provides a simple yet highly efficient mechanism for transferring coal from an environment at or near atmospheric pressure into a gasifier wherein the gas pressure may range up to about 1500 psig without the loss of the high pressure gas from within the gasifier. Further, the present invention provides a substantial improvement over prior art "dry coal" feeding techniques in that it is more efficient and less costly than lock-hopper arrangements.

What is claimed is:

1. A coal transfer device for transferring pulverized coal from a coal hopper to a coal gasifier operable at a substantially higher pressure than that within said hopper, comprising a hollow casing having diametrically opposed openings, one of which is in open communication with said hopper and the other of which is in open communication with said gasifier, a discoidal rotor disposed and rotatable within said casing an having a cavity therein defining a cylinder in open registry with the periphery of the rotor, seal means intermediate said rotor and said casing for interrupting fluid communication betweeen said openings, a piston disposed in said cylinder, a piston rod attached to said piston and projecting diametrically through the rotational axis of said rotor, contoured stationary cam means carried by said casing, cam follower means affixed to said piston rod and engaging said cam means, and drive mans coupled to said rotor for rotating said rotor about said axis while simultaneously driving said cam follower means along the contour of said cam means for reciprocating said piston within said cylinder, said contour of the cam means being of a configuration wherein the piston is displaced towards and maintained at a location contiguous to the outermost periphery of said rotor while the piston is in open communication with said gasifier for inhibiting gas therefrom from entering said cyliner.

2. A coal transfer device as claimed in claim 1, wherein said cam means comprises a conjugate cam having a drive cam for displacing said piston towards and maintaining it at said location and a return cam for displacing the piston towards and maintaining it contiguous to the radially innermost portion of said cylinder while said cylinder is in open communication with said hopper, and wherein said cam follower means comprises a first cam follower engaging said drive can and a second cam follower engaging said return cam.

3. A coal transfer device as claimed in claim 2, wherein said rotor has a central boss extending within said cavity along said rotational axis, said piston rod is carried by said boss, and bearing means are disposed intermediate said boss and said piston rod for allowing relative motion therebetween.

4. A coal transfer device as claimed in claim 3, wherein said piston rod projects substantially across the diameter of said rotor, and wherein further bearing means carried by said rotor are disposed about the piston rod near the distal end thereof remote to said piston.

5. A coal transfer device as claimed in claim 1, wherein a cup-shaped rolling diaphragm is disposed within said cylinder and is affixed to said piston for displacement therewith and to said rotor about the entire circumference of said cylinder for sealing the annular space intermediate the periphery of the piston and the walls of the cavity defining the cylinder.

6. A coal transfer device as claimed in claim 1, wherein annular bearing means are disposed intermediate the periphery of said rotor and said casing for facilitating the rotation of the rotor within said casing by said drive means.

* * * * *

UNITED STATES PATENT OFFICE
CERTIFICATE OF CORRECTION

Patent No. 4,025,317 Dated May 24, 1977

Inventor(s) Hasan T. Gencsoy

It is certified that error appears in the above-identified patent and that said Letters Patent are hereby corrected as shown below:

Column 1, line 11, "fro" should read --for--.
Column 2, line 21, "presure" should read --pressure--.
Column 3, line 11, "form" should read --from--; line 16, "produce" should read --product--; line 21 "recptacle" should read --receptacle--.
Column 4, line 1, "driven" should read --drive--.
Column 5, line 7, "an" should read --and--.
Column 6, line 37, "an" should read --and--; line 46, "mans" should read --means--; line 64, "can" should read --cam--.

Signed and Sealed this

*Twenty-fifth* Day of *October 1977*

[SEAL]

*Attest:*

RUTH C. MASON
*Attesting Officer*

LUTRELLE F. PARKER
*Acting Commissioner of Patents and Trademarks*